US006225752B1

(12) United States Patent
Matsubara et al.

(10) Patent No.: US 6,225,752 B1
(45) Date of Patent: May 1, 2001

(54) SPARK PLUG FOR INTERNAL COMBUSTION ENGINE

(75) Inventors: Yoshihiro Matsubara, Yokkaichi; Akio Kokubu; Kazumasa Yoshida, both of Nagoya; Makoto Yamaguchi, Owariasahi, all of (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 09/520,971

(22) Filed: Mar. 8, 2000

(30) Foreign Application Priority Data

Mar. 26, 1999 (JP) ..... 11-084298

(51) Int. Cl.[7] ..... H05B 37/02

(52) U.S. Cl. ..... 315/209 M; 313/118; 313/137; 313/145; 123/169 EL; 123/594

(58) Field of Search ..... 315/209 M; 123/169 EL, 123/169 R, 169 MG, 143 R, 594, 606, 608, 636; 313/118, 130, 131 A, 131 R, 136, 137, 145

(56) References Cited

U.S. PATENT DOCUMENTS 4,476,412 * 10/1984 Nishida et al. ..... 313/130
5,856,724 * 1/1999 Chiu et al. ..... 313/141
6,095,124 * 8/2000 Matsubara et al. ..... 123/594

FOREIGN PATENT DOCUMENTS 0 872 927 A2 10/1998 (EP) .
0 899 840 A1 3/1999 (EP) .

* cited by examiner

*Primary Examiner*—Haissa Philogene
(74) *Attorney, Agent, or Firm*—Morgan, Lewis & Bockius LLP

(57) ABSTRACT

A spark plug for an internal combustion engine is constituted by an insulating member (20) having an axial hole (26) formed along a central shaft (18); a rod-shape central electrode (12) accommodated in the axial hole; and a ground electrode (16) with which an igniting portion (16*a*) opposite to the outer surface (12*a*) of the central electrode is formed. In the spark plug, application of voltage between the central electrode and the ground electrode such that the polarity of the central electrode is made to be positive causes discharge to occur between the central electrode and the ground electrode. The spark plug satisfies at least one of the following conditions (a) and (b). (a) When the insulating member is cut along the central axis and a first extension line (60*a*) in the form obtained by outwards extending a line (60) indicating an end surface of said insulating member adjacent to the igniting portion and a second extension line (61*a*, 63*a*) in the form obtained by extending a line (61, 63) indicating the outer surface of the insulating member in the vicinity of the igniting portion are drawn, the distance tp from an intersection (62) between the first and second extension lines to a line indicating an inner surface of the axial hole adjacent to the igniting portion is 1.0 mm or shorter (tp ≦1.0 mm). (b) The difference ($\phi d_2 - \phi d_1$) between diameter $\phi d_1$ of the central electrode and diameter $\phi d_2$ of the axial hole is 0.08 mm or shorter {($\phi d_2 - \phi d_1$) ≦0.8 mm}.

8 Claims, 16 Drawing Sheets ga=0.6mm φd1=1.8mm tp=0.8mm φd2=1.86mm t1= mm Δφd=0.06mm

φd1=2.1mm t1=0.3mm

φd2=2.1mm+Δφd t2=0.5mm

FIG. 2

| PLUG | A | B | C | D | E |
|---|---|---|---|---|---|
| AIR GAP ga (mm) | 0.5 | 0.5 | 0.6 | 0.5 | 0.6 |
| THICKNESS tp OF INSULATING MEMBER (mm) (SURFACE GAP) | 1.1 | 0.9 | 0.9 | 1.1 | 0.9 |
| DIFFERENCE IN DIAMETER $\Delta\phi d$ (mm) | 0.09 | 0.09 | 0.09 | 0.06 | 0.06 |
| LENGTH L OF LEG (mm) | 12 | 12 | 12 | 13 | 13 |
| HEAT RESISTANCE PRE-IGNITION ADVANCEMENT (°) | 40 | 40 | 40 | 40 | 40 |
| CYCLE TO REACH 10MΩ IN PRE-DERIVERY TEST | 12 | 15 | 14 | 17 | 21 |
| IGNITEABILITY AIR-FUEL RATIO (A/F) OF MISFIRE | 17.4 | 17.1 | 17.4 | 17.4 | 17.4 |

ga=0.6mm φd1=1.8mm tp=0.8mm φd2=1.86mm t1= mm Δφd=0.06mm ga=0.6mm tp=0.8mm

φ d1=1.6mm

φ d2=1.66mm

Δ φ d=0.06mm ga=0.6mm tp=0.8mm

φd1=1.8mm

φd2=1.86mm

Δφd=0.06mm

W=1.1mm t3=0.4mm

φd1=1.8mm

φd2=1.86mm

Δφd=0.06mm ga=0.5mm L=12mm t1=0.3mm φd1=2.1mm t2=0.5mm φd2=2.18mm

× : PENETRATION OCCURRED

| tp(mm) | 0.7 | 0.8 | 0.9 | 1.0 | 1.1 |
|---|---|---|---|---|---|
| NEGATIVE | ××× | ××○ | ××○ | ○×○ | ○○○ |
| POSITIVE | ○○○ | ○○○ | ○○○ | ○○○ | ○○○ |

2.0L DOHC 5000rpmWOT 400Hrs ga=0.5mm tp=1.1mm t1=0.3mm t2=0.5mm

L=12mm

φd1=2.1mm

φd2=2.1mm+Δφd

CYCLIC TEST 500Hrs

× : CRACK OCCURRED

| Δφd(mm) | 0.06 | 0.07 | 0.08 | 0.09 | 0.10 |
|---|---|---|---|---|---|
| NEGATIVE | ×○× | ×○○ | ○○× | ○○○ | ○○○ |
| POSITIVE | ○○○ | ○○○ | ○○○ | ○○○ | ○○○ |

2.0L DOHC 5000rpm(1min)−Idlc(1min)

ga=0.5mm L=12mm tp=1.1mm φd2−φd1=Δφd=0.09mm

Δφd/2=0.045mm

SPARK PLUG FOR INTERNAL COMBUSTION ENGINE

BACKGROUND OF THE INVENTION

1. Field of the Invention

The present invention relates to a spark plug for use as an ignition source of an internal combustion engine, and more particularly to a semi surface discharge type spark plug having a structure that the igniting surface of a ground electrode is disposed opposite to the outer surface of a central electrode.

2. Description of the Related Art

Hitherto, a semi surface discharge type spark plug having a structure shown in FIGS. 14 and 15A to 15C is known. FIG. 14 is a partial cross sectional view of the semi surface discharge type spark plug. FIG. 15A is a cross sectional view showing a leading end portion (a spark discharge portion) of the semi surface discharge type spark plug shown in FIG. 14. FIG. 15B is a diagram showing a different-diameter portion (a gap) formed between a leading end 24*e* of an elongated leg portion 24 shown in FIG. 15A and an outer surface 12*a* of a central electrode 12. FIG. 15C is a diagram showing the thickness of the leading end 24*e* of the elongated leg portion 24 shown in FIG. 15A.

Note that description will now be made such that the lower portion shown in FIG. 14 is the leading end portion and the upper portion is the rear end portion.

The semi surface discharge type spark plug 10 is provided with an insulating member 20 made of alumina or the like. The insulating member 20 incorporates a corrugation portion 22 formed in the rear end portion thereof and an elongated leg portion 24 formed in the front end portion and formed into a pyramidal shape. The insulating member 20 has an axial hole 26 formed along a central axis 18 of the insulating member 20. A terminal 13 is accommodated in a rear end portion in the axial hole 26. The rear end of the terminal 13 projects over the rear end of the corrugation portion 22. The central electrode 12 is, through a glass resistance 11, accommodated in the axial hole 26 at a position adjacent to the terminal 13. The central electrode 12 is formed into a rod shape and made of an alloy mainly composed of nickel. A front surface 12*f* of the central electrode 12 projects over the leading end of the elongated leg portion 24 of the insulating member 20.

The leading end of the insulating member 20 is accommodated in a main metal shell 14 formed into a cylindrical portion. A leading end 24*e* of the elongated leg portion 24 projects over an opened front surface 14*c* of the main metal shell 14. A packing member 17 is disposed between the rear end of the elongated leg portion 24 and the main metal shell 14. A male thread portion 14*a* arranged to be screwed in a female thread portion provided for a cylinder head of an engine is formed around the leading end of the main metal shell 14. A base portion 16*b* of each of ground electrodes 16 is secured to a front surface 14*c* of the main metal shell 14.

Each of the ground electrodes 16 is bent into an L-like shape facing the central axis 18. An igniting surface 16*a* at the leading end of each of the ground electrodes 16 is disposed opposite to the outer surface 12*a* of the central electrode 12 so that an igniting portion SG is formed between the igniting surface 16*a* and the outer surface 12*a* (see FIG. 15A). As shown in FIG. 15A, a first gap g1 is formed between the outer surface 12*a* of the central electrode 12 and an igniting surface 16*a* of the ground electrodes 16. A second gap g2 is formed between the outer surface of the leading end 24*e* of the elongated leg portion 24 and the igniting surface 16*a*.

As shown in FIG. 14, a hexagonal portion 14*b* is formed at the rear end of the main metal shell 14 to permit a tool, such as a plug wrench, to be fit to the hexagonal portion 14*b* when the male thread portion 14*a* is screwed in a female portion provided for the cylinder head of the engine.

The thermal expansion coefficient is different between the central electrode 12 made of metal and the insulating member 20 made of alumina ceramic. Therefore, there is difference in the thermal expansion between the two elements. To prevent a fracture of the insulating member 20, a different-diameter portion (a gap) 15 is formed between the outer surface 12*b* of the central electrode 12 and the axial hole 26, as shown in FIG. 15B.

As shown in FIG. 15C, an intersection is formed between an extension line 60*a* drawn by outwards extending a line 60 indicating a side surface 24*f* of the elongated leg portion 24 adjacent to the igniting portion and an extension line 61*a* drawn by extending a line 61 indicating a side surface 24*c* of the elongated leg portion 24 toward the side surface 24*f* of the igniting portion. The distance (hereinafter called a "thickness") tp from the intersection to a line 65 indicating the inner surface of the axial hole 26 is 1.1 mm. Gap ga of the second gap g2 is 0.5 mm. Length (the axial directional distance from the side surface 24*f* of the elongated leg portion 24 to a sealing surface 24*g* to which the packing member 17 is joined, as shown in FIG. 14) L of the elongated leg portion 24 is 12 mm. The difference (hereinafter called the "difference $\Delta\phi d$ in the diameter") between diameter $\phi d_1$ of the central electrode 12 and diameter $\phi d_2$ of the axial hole 26 is 0.09 mm. Distance $\Delta\phi d/2$ of the different-diameter portion 15 is 0.09 mm/2=0.045 mm.

The male thread portion 14*a* of the main metal shell 14 is screwed in the female portion of the cylinder head. Thus, the semi surface discharge type spark plug 10 structured as described above is joined to the cylinder head such that the ground electrodes 16, the leading end 24*e* of the elongated leg portion 24 and the leading end of the central electrode 12 are exposed to the inside portion of the combustion chamber of the engine. Then, a high electric resistance cable is connected to the terminal 13. When discharge voltage is applied, a spark is ignited between the igniting surface 16*a* of the ground electrodes 16 and the central electrode 12. Thus, mixture in the combustion chamber is ignited.

The cleanability of a spark made by the spark plug for an internal combustion engine will now be described with reference to FIG. 16 which shows the principle of the cleanability.

As shown in FIG. 16, the discharge voltage is applied such that the central electrode 12 has negative polarity and the ground electrodes 16 has positive polarity. Therefore, the elongated leg portion 24 is charged with the positive polarity owing to dielectric polarization. Hence it follows that negatively-charged particles contained in the spark made at the end 12*g* of the central electrode 12 is attracted to the side surface 24*f* of the elongated leg portion 24. Therefore, the negatively-charged particles reach the igniting surface 16*a* of the ground electrodes 16 through a discharge passage formed along the side surface 24*f* of the elongated leg portion 24, as indicated with symbol S shown in FIG. 16.

Therefore, conductive fouling substances allowed to adhere to the side surface 24*f* of the elongated leg portion 24 owing to fouling are burnt out by the spark.

That is, fouling resistance of the semi surface discharge type spark plug having the above-mentioned spark cleanability is superior to that of an aerial discharge spark plug.

Problems to be Solved by the Invention

When sparks frequently move along the side surface 24*f* of the elongated leg portion 24, the energy of the spark causes the side surface 24*f* to be consumed. Thus, a groove 24*k* (see FIG. 16) is sometimes formed. That is, so-called "channeling" sometimes occurs. When channeling proceeds, a through portion is formed in a portion of the elongated leg portion 24 adjacent to the discharge passage S. As a result, a fracture of the elongated leg portion 24 occurs or heat resistance deteriorates. That is, there is apprehension that the durability of the spark plug deteriorates.

When metal oxides or the like produced owing to metal powder made owing to the consumption and owing to combustion are introduced and deposited in the different-diameter portion 15 (see FIG. 15B), the different-diameter portion 15 is clogged. When heat cycles in great temperature difference are rapidly repeated in the above-mentioned state, the difference between the thermal expansion of the elongated leg portion 24 and that of the central electrode 12 sometimes causes the elongated leg portion 24 to be broken. That is, there is apprehension that the durability of the spark plug deteriorates.

When the distance of the different-diameter portion 15 is enlarged, heat reduction becomes unsatisfactory. Thus, pre-ignition occurs, that is, heat resistance deteriorates. When an attempt to improve the heat reduction is made, the length L of the elongated leg portion 24 must be shortened.

In recent years, enlargement of the output of the engine causes a requirement for a spark plug having improved durability to arise.

SUMMARY OF THE INVENTION

An object of the present invention is to realize a spark plug for an internal combustion engine exhibiting excellent durability.

To achieve the foregoing object, according to the first to third aspects of the present invention, there is provided a spark plug for an internal combustion engine comprising: an insulating member having an axial hole formed along a central shaft; a rod-shape central electrode accommodated in the axial hole; and a ground electrode with which an igniting portion opposite to the outer surface of the central electrode is formed. In the spark plug according to the first to third aspect of the present invention, a common technical means is employed, in which voltage is applied between the central electrode and the ground electrode with the positive polarity of the central electrode so that discharge occur between the central electrode and the ground electrode.

When voltage is applied between the central electrode and the ground electrode such that the polarity of the control electrode is positive, the insulating member in which the control electrode is accommodated is negatively charged owing to dielectric polarization. Therefore, electrostatic repulsive actions are exerted from the insulating member brought to the negatively-charged state on negatively-charged particles contained in the spark made from the igniting surface of the ground electrode. Therefore, the possibility that the negatively-charged particles selects a passage (indicated with symbol S shown in FIG. 12A) distant from the insulating member to reach the central electrode is raised. Namely, the possibility that the passage along the end surface of the insulating member adjacent to the igniting portion is selected is lowered.

Therefore, occurrence of channeling can be prevented. Moreover, positive corona can easily be moved from the central electrode to prevent occurrence of penetration at the leading end of the insulating member. Therefore, the durability of the spark plug for an internal combustion engine can be improved. Since consumption of the leading end of the insulating member can be prevented, the quantity of metal powder produced due to consumption and introduced into the gap between the central electrode and the axial hole can be reduced. Hence it follows that a fracture of the insulating member owing to the difference between the thermal expansion of the central electrode and that of the insulating member can be prevented.

When voltage is applied between the central electrode and the ground electrode such that the polarity of the central electrode is made to be positive, the durability of the spark plug for an internal combustion engine can be improved.

The foregoing effects will be proved in the following experiments.

According to the first aspect of the present invention, the thickness tp of the insulating member is 1.0 mm or shorter. In the present specification, the "thickness tp" of the insulating member is defined as follows. Namely, when the insulating member is cut along the central axis and a first extension line in the form obtained by outwards extending a line indicating an end surface of the insulating member adjacent to the igniting portion and a second extension line in the form obtained by extending a line indicating the outer surface of the insulating member in the vicinity of the igniting portion are drawn, the distance from an intersection between the first and second extension lines to a line indicating an inner surface of the axial hole adjacent to the igniting portion is the thickness tp of the insulating member. The foregoing thickness is smaller than that (tp=1.1 mm) of the conventional structure shown in FIG. 15A. Therefore, the capacity of the leading end of the insulating member can be reduced. As a result, the thermal capacity of the leading end of the insulating member can be reduced.

Hence it follows that the temperature of the leading end of the insulating member can be raised. As a result, conductive fouling substances, such as carbon and metal oxides, allowed to adhere to the leading end of the insulating member can easily be burnt out. That is, the durability can furthermore be improved.

Since the thermal capacity of the leading end of the insulating member can be reduced, the leading end of the insulating member can quickly be cooled when mixture has been introduced into the combustion chamber. It leads to a fact that occurrence of pre-ignition can be prevented.

Since the thickness of the leading end of the insulating member can be reduced, the air gap between the igniting surface of the ground electrode and the insulating member can be enlarged. As a result, conduction between the ground electrode and the insulating member owing to deposition of carbon or the like, which is so-called "bridge", can be prevented.

As described above, the quantity of consumed metal powder into the gap between the central electrode and the axial hole can be reduced. Therefore, the gap between the central electrode and the axial hole can be narrowed. According to, for example, the second aspect of the invention, the difference ($\Delta\phi d$) between the diameter of the central electrode and the diameter of the axial hole is 0.08 mm or smaller. Since the foregoing difference is smaller than that of the conventional structure ($\Delta\phi d$=0.09 mm) shown in FIG. 15A, the heat reduction can be improved.

That is, according to the second aspect of the invention, the length of the leg of the insulating member can be elongated to improve the heat resistance.

According to the third aspect of the invention, both of the structures according to the first and the second aspects are employed. Therefore, the durability of the spark plug for an internal combustion engine can furthermore be improved.

BRIEF DESCRIPTION OF THE DRAWINGS

In the accompanying drawings:

FIG. 2 is a table showing results of Experiment 1;

PREFERRED EMBODIMENTS OF THE INVENTION

Preferred embodiments of a spark plug for an internal combustion engine according to the present invention will now be described with reference to the drawings.

Figure 1A:
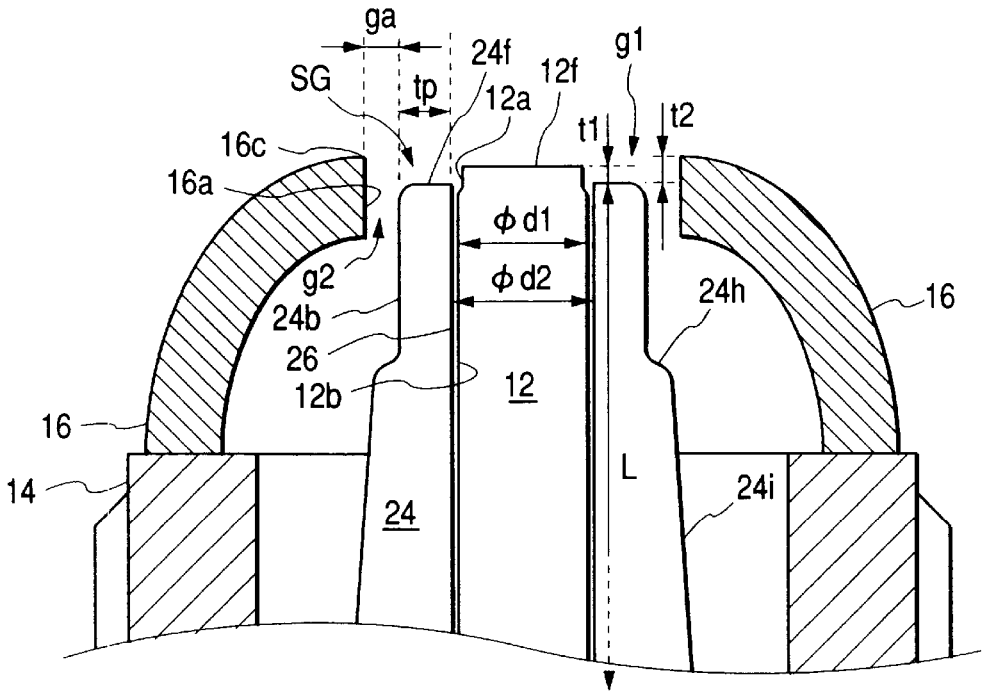
FIG. 1A is a partially and enlarged cross sectional view showing the leading end of a spark plug for an internal combustion engine according to an embodiment of the present invention.
Figure 1B:
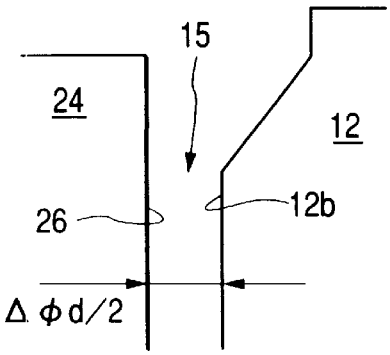
FIG. 1B is a diagram showing a different-diameter portion formed between the central electrode of the spark plug for an internal combustion engine shown in FIG. 1A and an elongated leg portion.
Figure 1C:
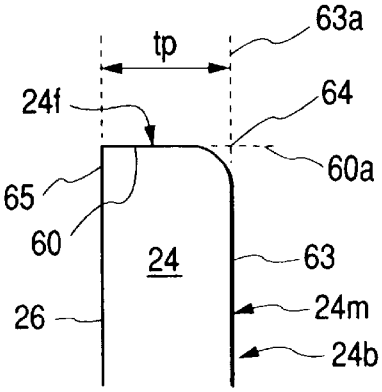
FIG. 1C is a diagram showing the thickness of the elongated leg portion of the spark plug for an internal combustion engine shown in FIG. 1A.

FIG. 1A is a partial and enlarged cross sectional view showing the leading end of a spark plug for an internal combustion engine according to this embodiment. FIG. 1B is a diagram showing a different-diameter portion formed between the central electrode of the spark plug for an internal combustion engine shown in FIG. 1A and an elongated leg portion of the same. FIG. 1C is a diagram showing the thickness of the elongated leg portion of the spark plug for an internal combustion engine shown in FIG. 1A.

Figure 14:
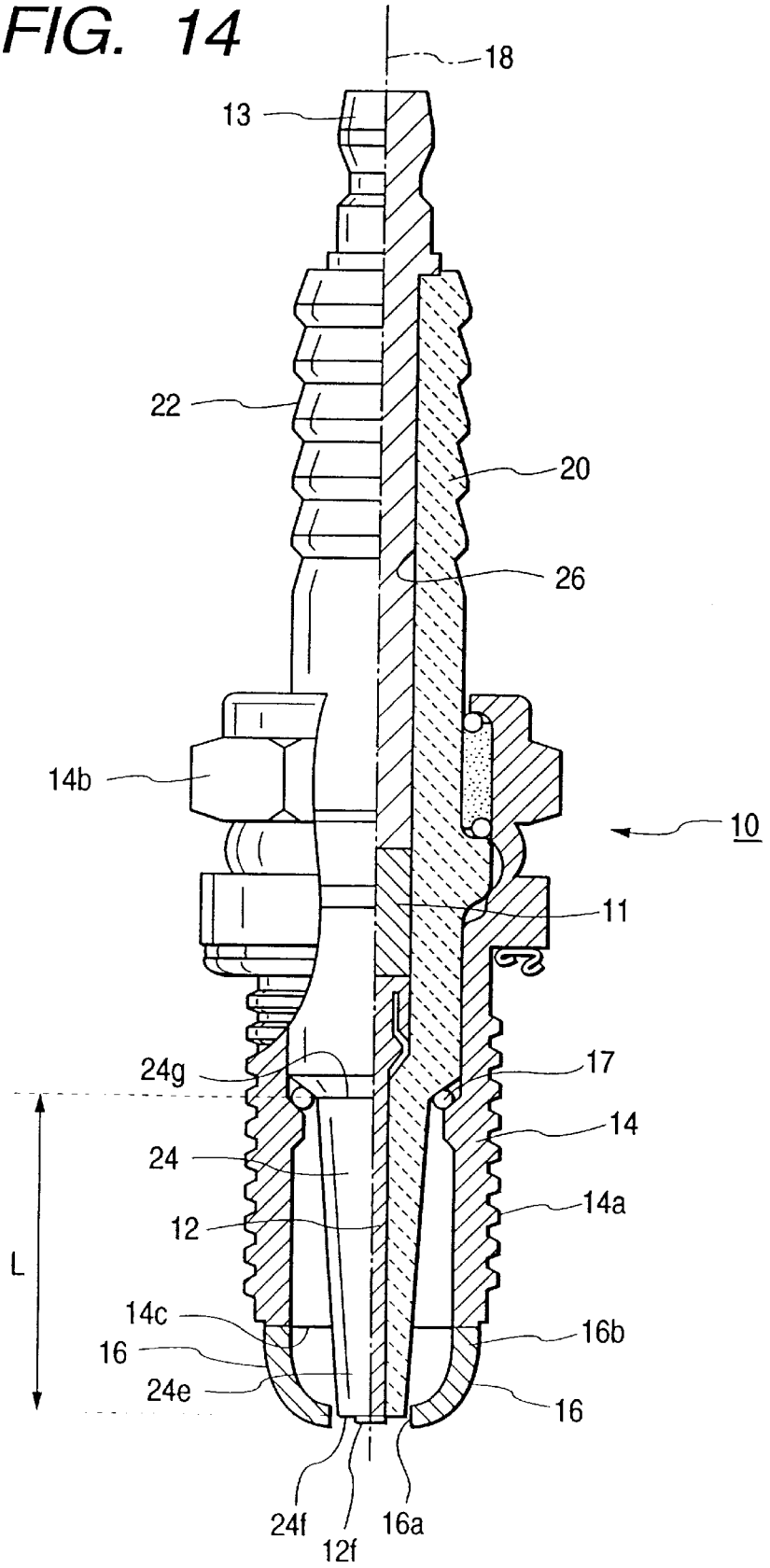
PRIOR ART FIG. 14
FIG. 14 is a partial cross sectional view showing a conventional semi-creepage discharge spark plug.
Figure 15A:
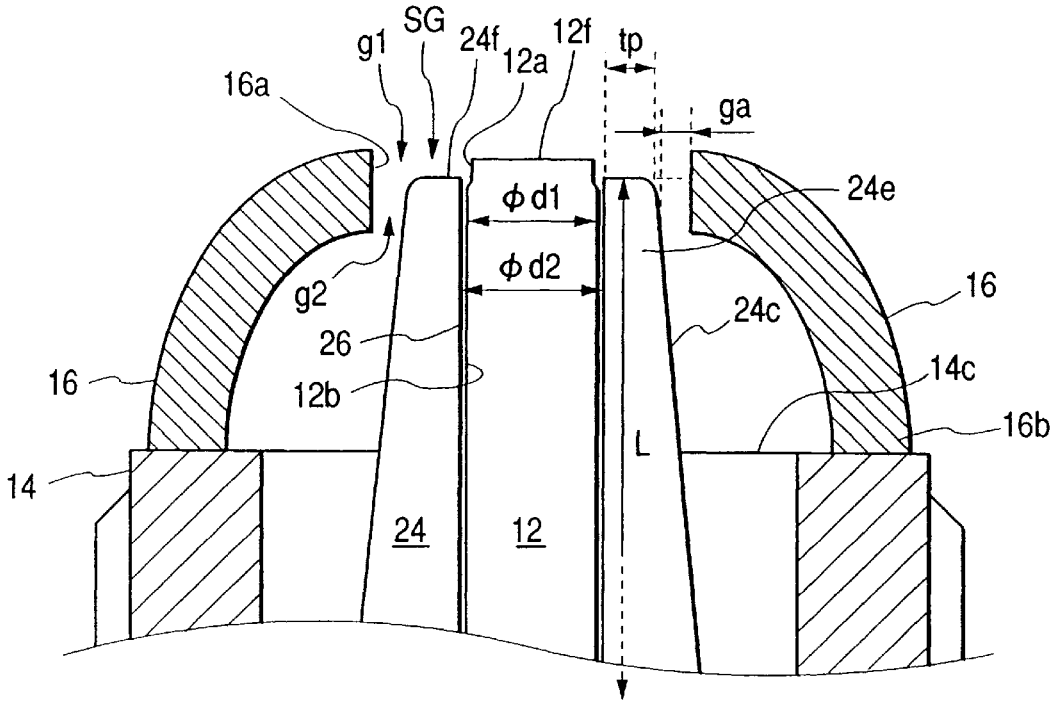
PRIOR ART FIG. 15A
FIG. 15A is a cross sectional view showing the leading end of the semi-creepage spark plug shown in FIG. 14.
Figure 15B:
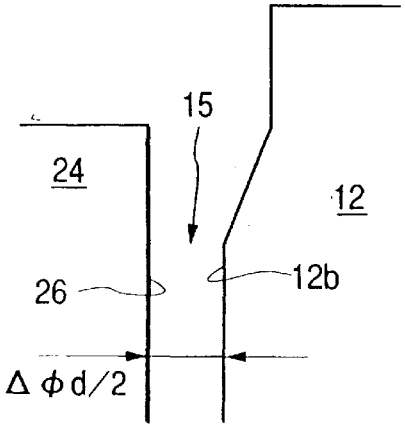
PRIOR ART FIG. 15B
FIG. 15B is a diagram showing a different-diameter portion (a gap) formed between the leading end 24*e* of the elongated leg portion 24 and the outer surface 12*a* of the central electrode 12 shown in FIG. 15A.
Figure 15C:
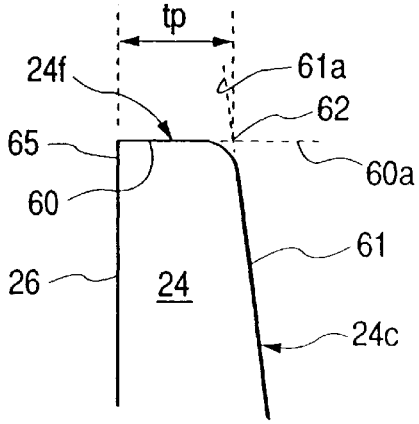
PRIOR ART FIG. 15C
FIG. 15C is a diagram showing the thickness of the leading end 24*e* of the elongated leg portion 24 shown in FIG. 15A.
Figure 16:
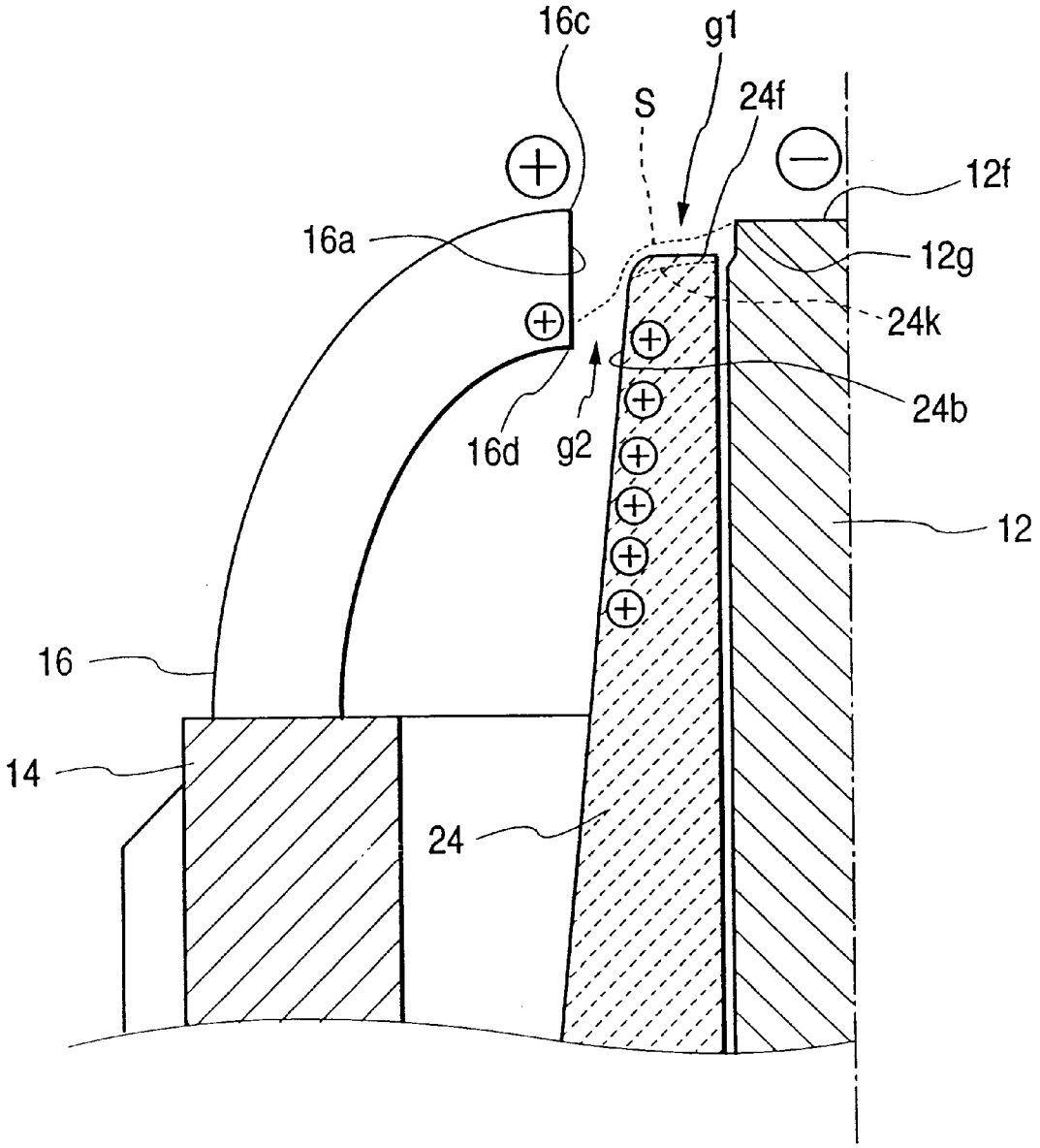
PRIOR ART FIG. 16
FIG. 16 is a diagram showing the principle of self-cleanability of the semi-creepage discharge spark plug.

The same structures as those of the conventional spark plug shown in FIGS. 14 to 16 are given the same reference numerals and the same structures are omitted from description.

As shown in FIG. 1A, an inclined portion 24*i* inclined toward the central axis of a central electrode 12 is provided for the rear end portion of an elongated leg portion 24. A restriction 24*h* restricted toward the central axis is provided for the upper end of the inclined portion 24*i*. A straight portion 24*b* extending in the vertical direction is formed in a region from the restriction 24*h* to the side surface 24*f*.

That is, the thickness of the elongated leg portion 24 is gradually reduced from the inclined portion 24*i* to the restriction 24*h*. Moreover, the thickness is furthermore reduced in the straight portion 24*b* formed upper than the restriction 24*h*.

The thickness tp of the insulating member in the elongated leg portion 24 is, as shown in FIG. 1C, defined as the distance from an intersection 64 between an extension line 60*a* drawn by outwards extending a line 60 indicating a side surface 24*f* of the elongated leg portion 24 adjacent to the igniting portion and an extension line 63*a* drawn by extending a line 63 indicating an outer surface 24*m* of a straight portion 24*b* of the elongated leg portion 24 and a line 65 indicating the inner surface of an axial hole 26.

In this embodiment, diameter $\phi d_1$ of the central electrode 12 is 2.1 mm and diameter $\phi d_2$ of the axial hole 26 is 2.1 mm $+\Delta\phi d$. Note that $\Delta\phi d$ is the difference between the diameter of the central electrode 12 and that of the axial hole 26. Therefore, the distance of the different-diameter portion formed between the outer surface 12*b* of the central electrode 12 and the axial hole 26 is, as shown in FIG. 1B, $\Delta\phi d/2$.

Height t1 of projection of the central electrode 12 which projects over the side surface 24*f* of the elongated leg portion 24 adjacent to the igniting portion is 0.3 mm. Height t2 from the side surface 24*f* adjacent to the igniting portion to an upper end 16*c* of an igniting surface 16*a* of a ground electrodes 16 is 0.5 mm.

Then, the structure of a circuit for the spark plug for an internal combustion engine having the above-mentioned structure to apply voltage such that polarity of the central electrode 12 is made to be positive will now be described with reference to FIGS. 9 and 10.

Figure 9A:
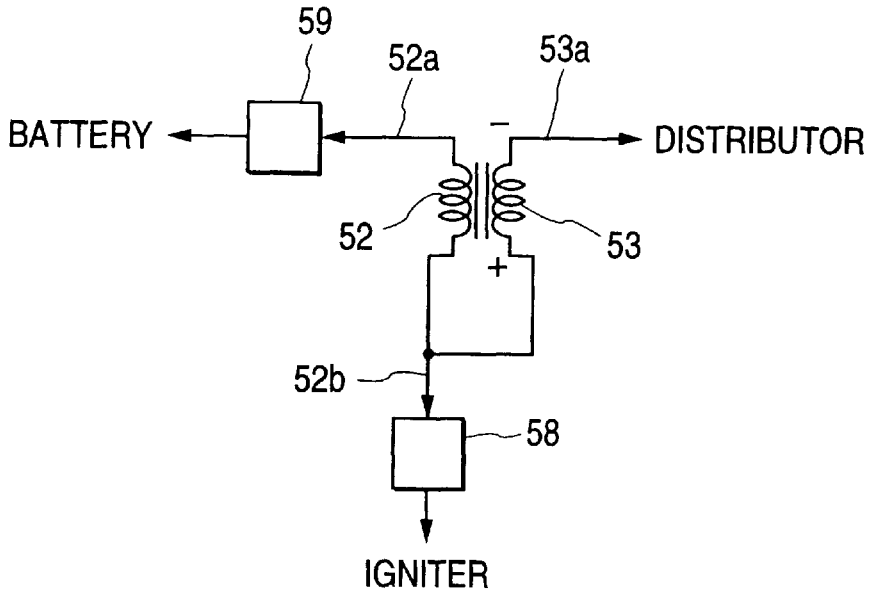
FIG. 9A is a diagram showing the structure of a conventional ignition system.
Figure 9B:
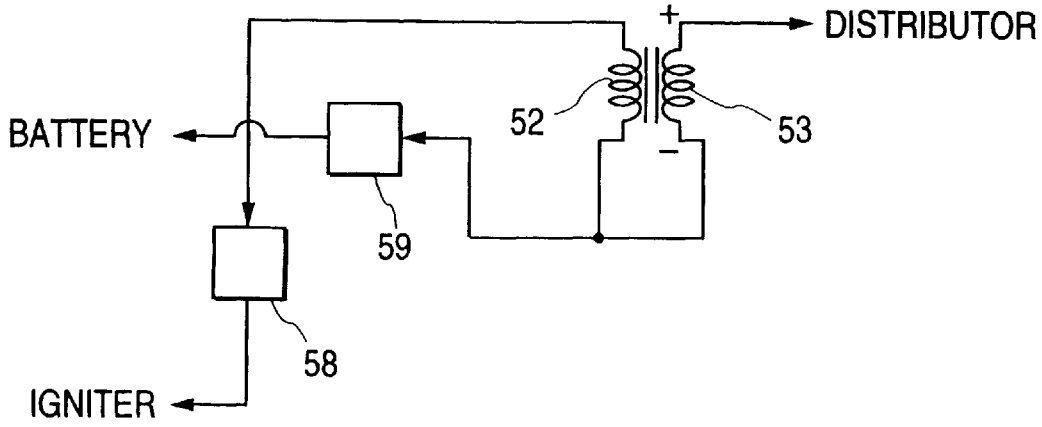
FIG. 9B is a diagram showing the structure which is employed when a portion of the specifications of the ignition system shown in FIG. 9A has been changed.

FIG. 9A is a diagram showing the structure of a conventional ignition system. FIG. 9B is a diagram showing the structure of a circuit which is employed when a portion of specifications of the ignition system shown in FIG. 9A has been changed.

As shown in FIG. 9A, the conventional ignition system incorporates a negative terminal 52*a* of a primary coil 52 connected to a socket 59 of the battery. Similarly, a positive terminal 52*b* is connected to a socket 58 of an igniter. A negative terminal 53*a* of a secondary coil 53 is connected to a distributor. When the foregoing relationship of connection is inverted as shown in FIG. 9B, application of voltage such that the polarity of the central electrode 12 is made to be positive can be performed.

When the design of the ignition system is fundamentally changed, the following method may be employed. The method of changing the design is shown in FIGS. 10A to 10C.

Figure 10A:
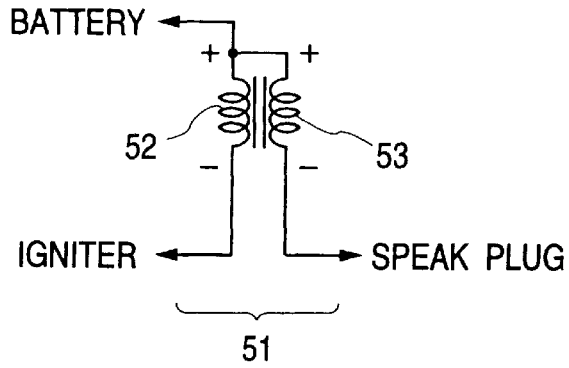
FIGS. 10A to 10C are diagrams showing a method of fundamentally changing the ignition system.
Figure 10B:
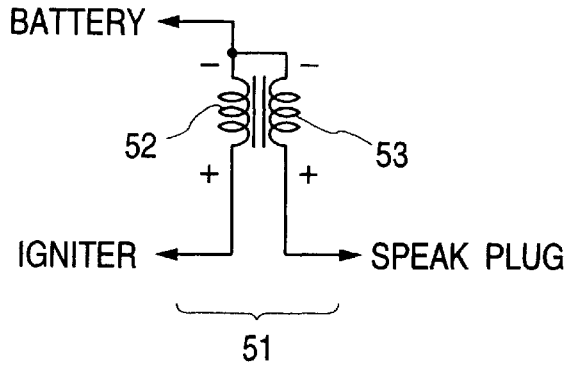
Figure 10C:
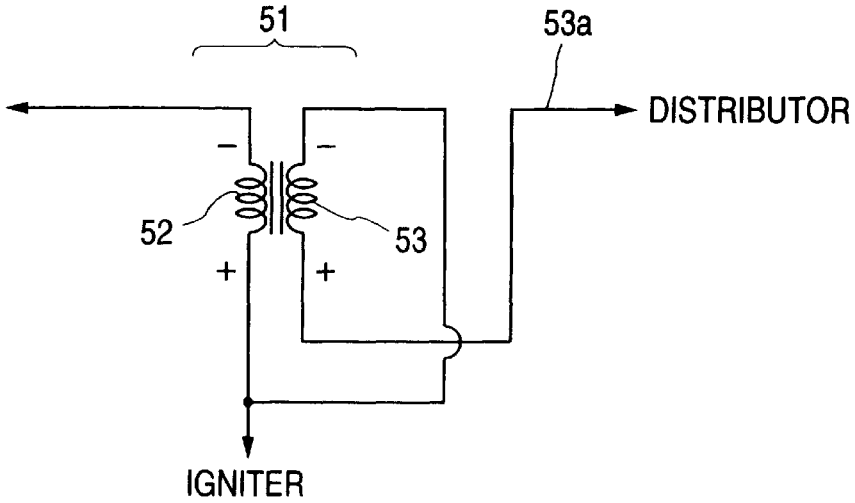

When the conventional ignition system is, as shown in FIG. 10A, designed such that the polarity of the output from the secondary coil 53 constituting the ignition coil 51 to the spark plug is made to be negative, the design is changed such that the direction of winding of either of the secondary coil 53 or the primary coil 52 is inverted, as shown in FIG. 10B. Moreover, the relationship of connection between the secondary coil 53, the distributor and the igniter is inverted, as shown in FIG. 10C.

The operation of the spark plug for an internal combustion engine according to this embodiment will now be described.

Figure 12A:
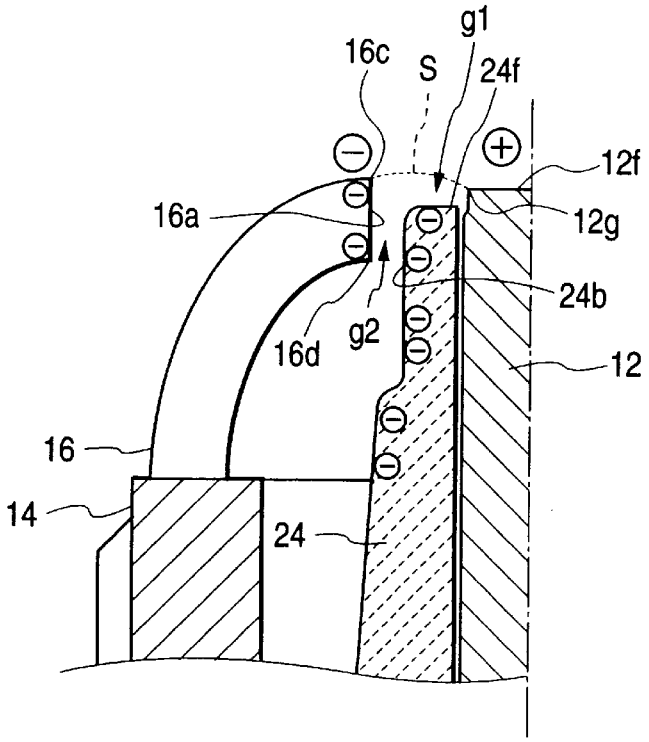
FIG. 12A is a diagram showing the potential and a discharge passage of the spark plug for an internal combustion engine according to the embodiment of the present invention.
Figure 12B:
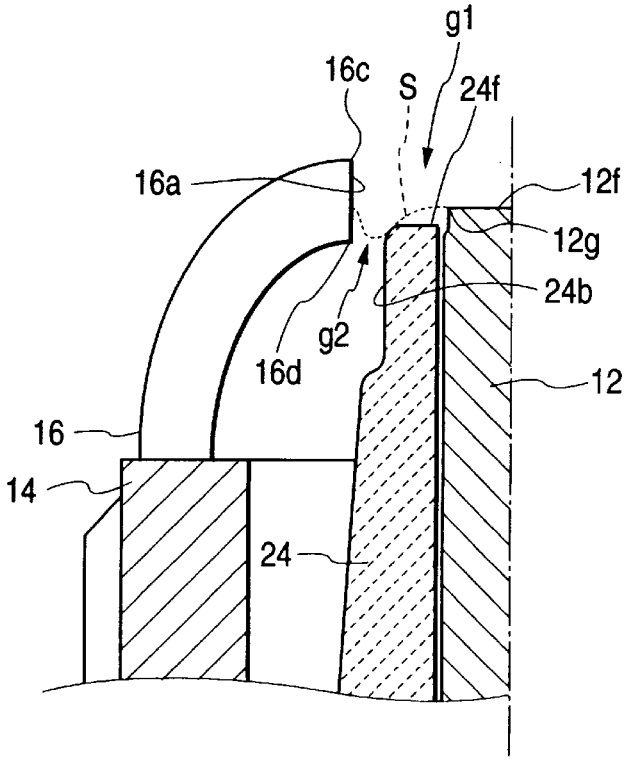
FIG. 12B is a diagram showing a discharge passage different from the discharge passage shown in FIG. 12A.

FIG. 12A is a diagram showing the polarity of the spark plug for an internal combustion engine according to this embodiment and a discharge passage. FIG. 12B is a diagram showing a discharge passage different from the discharge passage shown in FIG. 12A.

The spark plug for an internal combustion engine according to this embodiment is, as shown in FIG. 12A, structured such that the central electrode 12 is positively charged. Therefore, an assumption is made that the dielectric polarization causes the elongated leg portion 24 of the insulating member to be brought to the negatively-charged state. Although a spark formed as a flow of negatively-charged particles partially propagating through a passage along the side surface 24*f* of the elongated leg portion 24 adjacent to the igniting portion, electrostatic repulsive actions caused from negative charges of the side surface 24*f* are exerted on the spark. Therefore, the spark mainly propagates such that the side surface 24*f* adjacent to the igniting portion is bypassed. As a result, the possibility of propagation of the spark along the side surface 24*f* adjacent to the igniting portion is lowered. Thus, it can be considered that channeling on the side surface 24*f* adjacent to the igniting portion does not easily take place.

When the central electrode 12 is positively charged, the side surface 24*f* of the elongated leg portion 24 adjacent to the igniting portion is negatively charged. The length of the aerial discharge passage for a spark is shorter when the spark is made at the upper end 16*c* as compared with a case where a spark is made at the lower end 16*d* of the igniting surface 16*a* of the ground electrodes 16. Therefore, it can be considered that the possibility that the spark discharge moves in a passage which bypasses the side surface 24*f* adjacent to the igniting portion is raised.

The structure of the conventional spark plug for an internal combustion engine shown in FIG. 16 causes the length of the aerial discharge passage to be shorter when the spark moves along the side surface 24*f* of the elongated leg portion 24 adjacent to the igniting portion and moves toward the lower end 16*d* of the igniting surface 16*a*. Therefore, frequency at which sparks move to the lower end 16*d* is raised. Thus, channeling easily takes place.

Another fact can be considered as follows.

When high voltage is applied between the electrodes of a spark plug, corona discharge occurs prior to the spark discharge. The foregoing phenomenon is a luminous phenomenon which occurs owing to partial electrical breakdown which takes place in a portion in which the surface electric field is intense. It can be considered that a state of the corona discharge dominates the behavior of spark discharge which occurs in succession (moreover, glow discharge or arc discharge which is undesirable discharge because the electrode is consumed).

A fact is known that the state of the corona discharge occurs in a different manner between the positive electrode and the negative electrode. When, for example, a needle electrode is disposed opposite to a plane electrode and the voltage between the electrodes is raised such that the potential of the needle electrode is made to be positive, only a thin light film called "glow corona" (one of point discharge phenomena) is produced in a state where the voltage level is low. A fact is known that when the voltage has been raised, the state is easily shifted to a state called a "brush discharge" with which branch light emitting portions intermittently and fiercely extend with sound. Note that the brush discharge is sometimes distinguished from streamer corona which furthermore approaches the spark discharge ("High Voltage Engineering", pp. 42, 1971, Asakura Bookseller).

When the potential of the needle electrode is made to be negative, the change in the state of discharge becomes unclear. Therefore, when the voltage is raised, a state of discharge like the glow corona is maintained in the vicinity of the leading end of the electrode. Hence it follows that the state cannot easily progress to the branch-shape light.

A consideration is made when the foregoing phenomenon is applied to the discharge between the electrodes of the spark plug. When the potential of the central electrode 12 is made to be negative similarly to the conventional structure shown in FIG. 16, corona advanced in, for example, a brush discharge state reaches the central electrode 12 such that the upper end 16*c* and the lower end 16*d* of the ground electrodes 16 are leading ends of the negative electrode in a sense. Thus, breakdown of the spark discharge occurs. In the foregoing case, the electric field at the lower end 16*d* of the ground electrodes 16 is intensified maximally. Therefore, the discharge passage can easily be formed along the side surface 24*f* of the elongated leg portion 24 adjacent to the igniting portion.

When the potential of the central electrode 12 is made to be positive similar to the spark plug for an internal combustion engine according to this embodiment shown in FIG. 12A, the end 12*g* of the central electrode serves as the leading end of the positive electrode. Thus, corona advanced from the leading end reaches the igniting surface 16*a* of the ground electrodes 16. Thus, it can be considered that breakdown of the spark discharge occurs. In the foregoing case, the ground electrodes 16 is, in the air, distant from the elongated leg portion 24. Therefore, an influence of the elongated leg portion 24 does not easily exerted on the concentration of electric fields.

Hence it follows that the formed discharge passage is somewhat upwards separated from the side surface 24*f* of the elongated leg portion 24 adjacent to the igniting portion. Therefore, channeling of the side surface 24*f* owing to spark attacks cannot easily occur.

Since the corona extends from the elongated leg portion 24, penetration of the elongated leg portion 24 does not easily occur. The reason for this will now be considered. The conventional structure shown in FIG. 16 causes the corona to extend from the igniting surface 16*a* of the ground electrodes 16. Therefore, a stress of the high voltage is directly exerted on the elongated leg portion 24. On the other hand, the spark plug for an internal combustion engine according to this embodiment and structured as shown in FIG. 12A enables the voltage which is applied to the elongated leg portion 24 to be lowered. Thus, the stress can be prevented.

When the side surface 24*f* of the elongated leg portion 24 approaches the lower end 16*d* of the igniting surface 16*a* of the ground electrodes 16, channeling resistance sometimes deteriorates.

Since the potential of the applied voltage during the discharge is positive at the central electrode 12, it can be considered from the general behavior of the corona discharge on the positive electrode side that corona advanced from the end 12*g* of the central electrode 12 extends toward the igniting surface 16*a* of the ground electrodes 16. Since the corona approaches the lower end 16*d* of the igniting surface 16*a,* it can be considered that corona reaches the lower end 16*d* and, therefore, breakdown occurs. As a result, a discharge passage is formed along the side surface 24*f* of the elongated leg portion 24 at a position adjacent to the lower end 16*d*. Therefore, frequency of occurrence is sometimes raised. In the foregoing case, it is effective to employ a countermeasure such as provision of round corners for the lower end 16*d* of the igniting surface 16*a* or performing of chamfering of the same to lower the frequency of occurrence Spark cleanability of the spark plug for an internal combustion engine according to this embodiment will now be described with reference to FIG. 13.

Figure 13A:
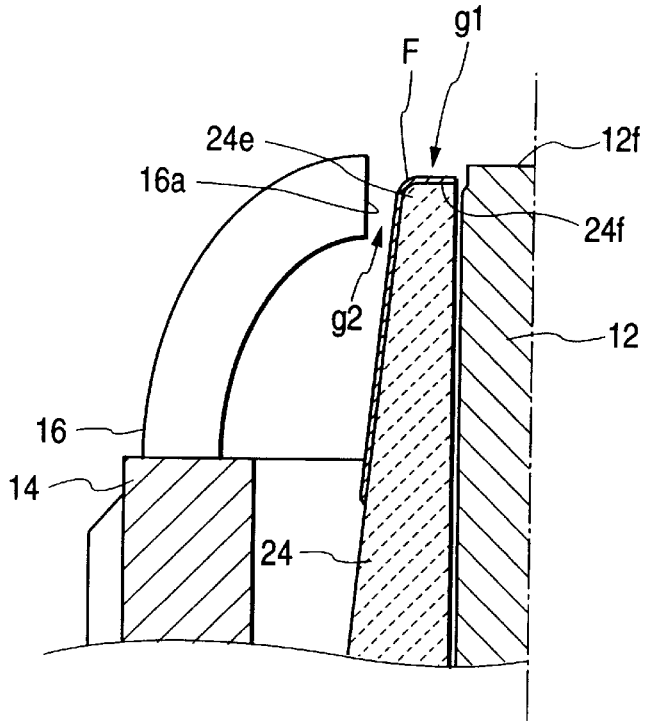
FIG. 13A is a diagram showing a state where a conductive layer is provided for an insulating member.
Figure 13B:
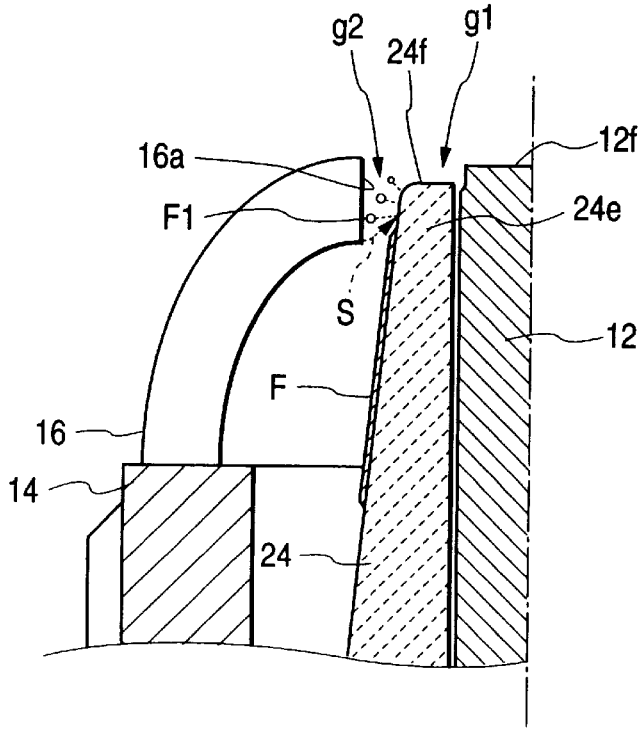
FIG. 13B is a diagram showing a state where the conductive layer is burnt out.

FIG. 13A is a diagram showing a state in which a conductive layer has been formed on the insulating member. FIG. 13B is a diagram showing a state in which the conductive layer is burnt out.

When fouling becomes severs owing to carbon fouling or wet fouling, conductive layer F composed of conductive substances, such as carbon and metal oxides, are formed on the outer surface of the elongated leg portion 24 of the insulating member, as shown in FIG. 13A. Thus, electric resistance of the outer surface of the elongated leg portion 24 is lowered, causing the discharge voltage to be lowered. As a result, a spark can easily be made in a space from the elongated leg portion 24 disposed adjacent to the ground electrodes 16. When spark discharge occurs, conductive particles F1 constituting the conductive layer F are dispersed owing to the spark, as shown in FIG. 13B. Therefore, the state of fouling of the spark plug for an internal combustion engine can be improved. It can be considered that the discharge state shown in FIG. 12A is restored after the conductive layer F has been burnt out.

The spark plug for an internal combustion engine according to this embodiment, as shown in FIG. 1A, has the structure that the front surface 12*f* of the central electrode 12 projects over the side surface 24*f* of the elongated leg portion 24 adjacent to the igniting portion. Therefore, the first gap g1 is formed between the outer surface 12*a* of the projection and the igniting surface 16*a* of the ground electrodes 16. On the other hand, the second gap g2 is formed between the outer surface of the leading end of the elongated leg portion 24 and the igniting surface 16*a*. Therefore, when fouling has not proceeded considerably, spark discharge occurs at the first gap g1 when the fouling has proceeded, the spark discharge occurs at the second gap g2. Therefore, it can be considered that a fouling detecting and cleaning function is provided which is capable of automatically detecting the degree of progress of the fouling of the outer surface of the elongated leg portion 24 to burn out the fouling.

Three experiments performed by the inventors of the present invention and their results will now be described.

Experiment 1

The inventors performed experiments to examine influences of the thickness tp of the insulating member at the leading end of the elongated leg portion 24 of the insulating member 20 and the difference Δϕd between the central electrode 12 and the axial hole 26 on the durability of the spark plug for an internal combustion engine. Results of the experiments were shown in FIG. 2.

Figure 11:
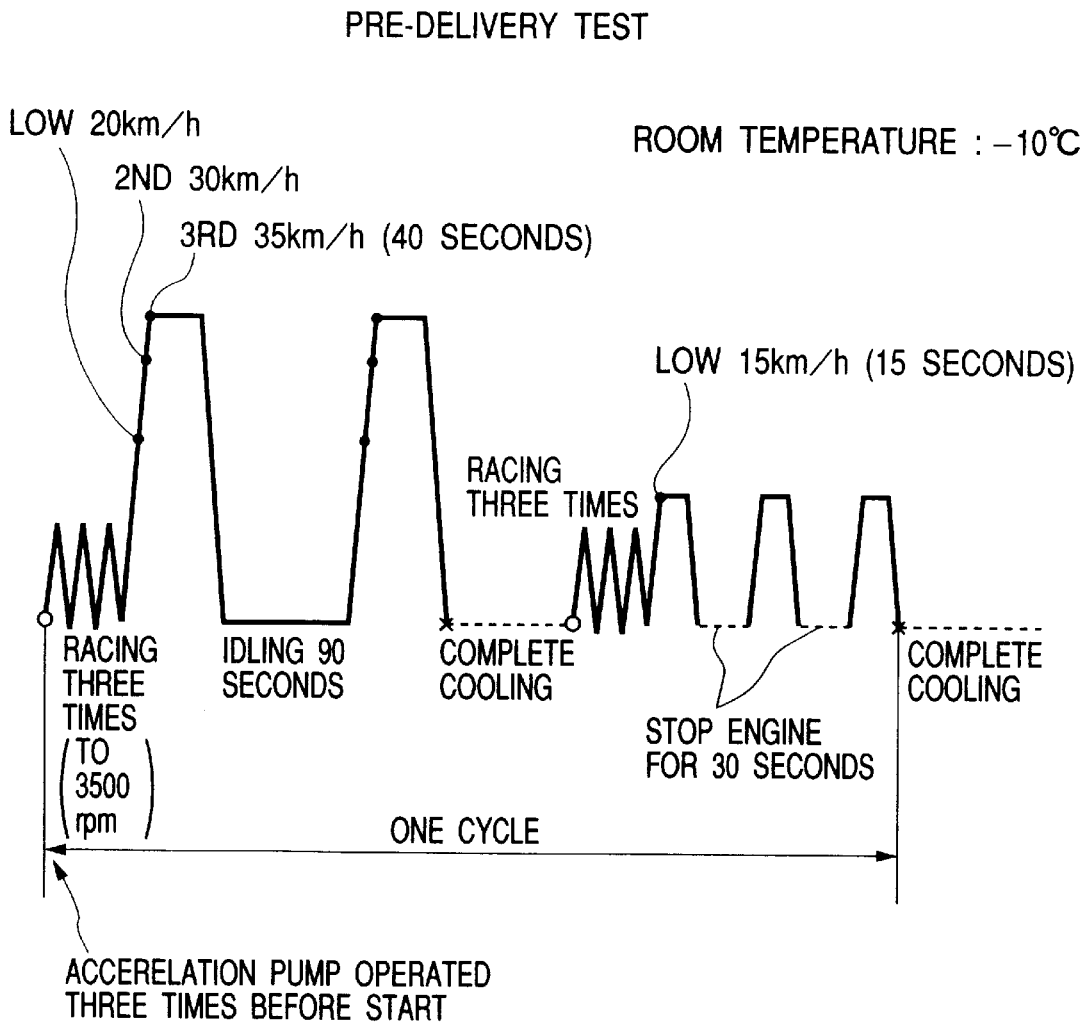
FIG. 11 is a diagram showing contents of a pre-delivery test.

Referring to FIG. 2, the "heat-resisting pre-ignition advance" is an advance at which pre-ignition occurs. The "number of cycles required to reach 10 MΩ in a pre-delivery test" is the number of cycles required for the insulation resistance of the spark plug for an internal combustion engine to be lowered to 10 MΩ in a smoke fouling test regulated in a test (JIS D 1606) for adaptability of a spark plug for an automobile to an engine (see FIG. 11).

That is, as the number of the cycles is increased, reduction in the insulation resistance is delayed. That is, conductive and fouling substances, such as carbon and metal oxides, cannot easily be accumulated (excellent in fouling resistance).

The "ignitability and air-fuel ratio (A/F) at which misfire occurs" is an air-fuel ratio at which 1% misfire occurs.

In the experiments, spark plugs A to E for internal combustion engines were employed. Plug A was the conventional spark plug for an internal combustion engine shown in FIGS. 14 and 15A having a structure that the air gap ga was 0.5 mm and the thickness tp of the insulating member was 1.1 mm.

Plug B corresponded to the first aspect of the invention and had a structure that the thickness tp of the insulating member was 0.9 mm which was smaller than that of plug A by 0.2 mm.

As shown in FIG. 2, the number of cycles required for plug B to reach 10 MΩ in the pre-delivery fouling test was 15 which was larger than 12 cycles required for the conventional plug A by 3 cycles.

That is, a fact was detected that the reduction of the thickness tp of the insulating member improved the fouling resistance.

Plug C corresponded to another embodiment of the first aspect and structured such that the thickness tp of the insulating member was reduced by 0.2 mm as compared with that of the conventional plug A and the air gap ga was enlarged to 0.6 mm which was larger than that of the conventional plug A by 0.1 mm. As shown in FIG. 2, the number of cycles required for plug C to reach 10 MΩ in the pre-delivery fouling test was 14 which was larger than 12 required for the conventional plug A by 2.

That is, a fact was detected that also in a case where the thickness tp of the insulating member was reduced and the air gap ga was enlarged, improvement in the fouling resistance was permitted.

An assumption which was not shown in FIG. 2 was made that enlargement of the air gap prevented easy occurrence of the foregoing bridge.

Plug D corresponded to the second aspect of the invention and structured such that the air gap ga and the thickness tp of the insulating member were the same as those of the conventional plug A. Moreover, the difference Δϕd in the diameter was 0.06 mm which was smaller than 0.09 mm of the conventional plug A by 0.03 mm. In addition, the length L of the elongated leg portion 24 was 13 mm which was longer than 12 mm of the conventional plug A by 1 mm. As shown in FIG. 2, the number of cycles required for plug D to reach 10 MΩ in the pre-delivery fouling test was 17 which were larger than 12 cycles required for the conventional plug A by 5 cycles. The number of cycles was larger than that required for plug B and that required for plug C.

That is, a fact was detected that when the difference Δϕd of the diameter was reduced and the length L of the leg was elongated, the fouling resistance was furthermore improved.

Plug E corresponded to the third aspect of the invention and structured such that the air gap ga and the thickness tp of the insulating member were the same as those of plug C. Moreover, the difference Δϕd in the diameter and the length L of the leg were the same as those of plug D. As shown in FIG. 2, the number of cycles required for plug E to reach 10 MΩ in the pre-delivery fouling test was 21 which was larger than 12 cycles required for the conventional plug A by 9 cycles. The foregoing number of cycles was largest among all of the plugs.

That is, a fact was detected that the fouling resistance was furthermore improved when the thickness tp of the insulating member was reduced, the air gap ga was enlarged, the difference Δϕd of the diameter was reduced and the length L of the leg was elongated. Hence it follows that the fouling resistance can furthermore be improved.

Experiment 2

Figures 7A, 7B:
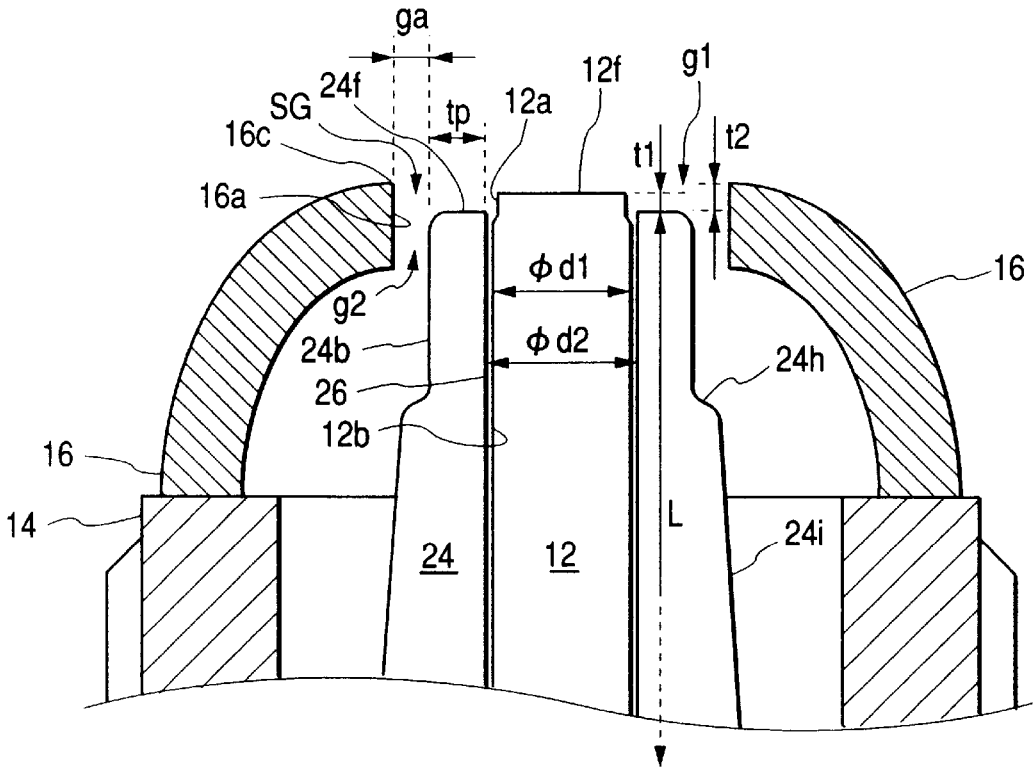
FIG. 7A is partially and enlarged cross sectional view showing the leading end of a spark plug for an internal combustion engine employed in Experiment 2.
FIG. 7B is a table showing results of Experiment 2.

Then, the inventors performed experiments to examine an influence of the thickness tp of the insulating member on occurrence of penetration. FIG. 7A is a partial and enlarged cross sectional view showing the leading ends of the spark plugs for internal combustion engines for use in the experiments. FIG. 7B is a table showing results of the experiments.

As shown in FIG. 7A, the spark plug for an internal combustion engine for use in this experiment had a structure that the air gap ga was 0.5 mm, height t1 of projection of the central electrode 12 over the elongated leg portion 24 was 0.3 mm and height t2 of the elongated leg portion 24 from the side surface 24*f* adjacent to the igniting portion to the upper end 16*c* of the igniting surface 16*a* was 0.5 mm. Moreover, the length L of the leg was 12 mm, the diameter ϕd1 of the central electrode 12 was 2.1 mm and the diameter ϕd2 of the axial hole 26 was 2.18 mm.

The experiment was performed three times such that the spark plug for an internal combustion engine shown in FIG. 7A was mounted on a six-cylinder and 2-liter DOHC engine. Then, the engine was operated at 5,000 rpm for 400 hours in a throttle WOT (Wide Open Throttle) state. The thickness tp of the insulating member was changed in a range from 0.7 mm to 1.1 mm in a case where the potential of the central electrode 12 was made to be negative similarly to the conventional structure and in a case where the same was made to be positive like the present invention. Thus, whether or not penetration occurred was examined.

In FIG. 7B, symbol O indicates no occurrence of the penetration and symbol x indicated occurrence of deep channeling (0.4 mm or more) or occurrence of the penetration.

When the potential of the central electrode 12 was negative, penetration occurred in a range in which the thickness tp of the insulating member satisfied a range from 0.7 mm to 1.0 mm, as shown in FIG. 7B. When the potential of the central electrode 12 was positive, no penetration occurred in all of the three experiments over the range of the thickness tp of the insulating member from 0.7 mm to 1.1 mm.

That is, the present invention structured such that the potential of the central electrode 12 was made to be positive and voltage was applied was able to prevent penetration if the thickness tp of the insulating member was reduced.

Experiment 3

Figures 8A, 8B:
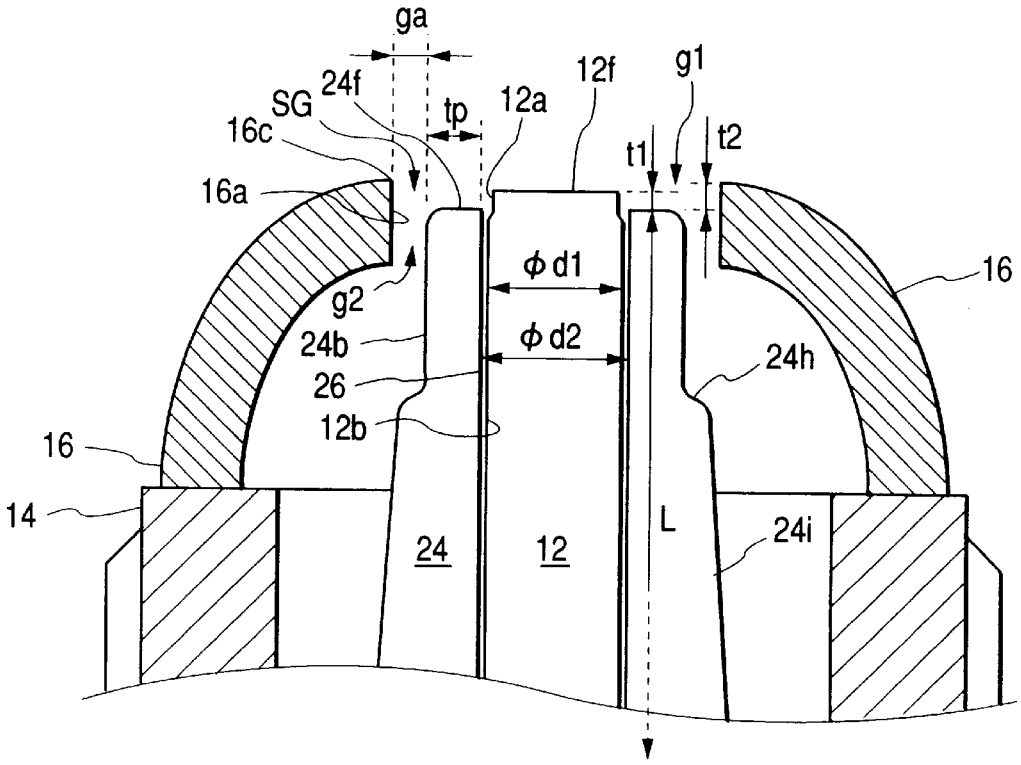
FIG. 8A is a partially and enlarged cross sectional view showing the leading end of a spark plug for an internal combustion engine employed in experiment 3.
FIG. 8B is a table showing results of Experiment 3.

The inventors performed experiments to examine an influence of the difference Δϕd on occurrence of fracture of the insulating member. FIG. 8A is a partial and enlarged cross sectional view showing the leading end of the spark plug for an internal combustion engine for use in the experiments. FIG. 8B is a table showing results of the experiments.

As shown in FIG. 8A, the spark plug for an internal combustion engine for state in the experiments was same as the spark plug for an internal combustion engine for use in Experiment 2 except for the thickness tp of the insulating member which was 1.1 mm.

The experiment was performed three times such that the spark plug for an internal combustion engine shown in FIG. 8A was mounted on a 6-cylinder and 2.0-litter DOHC engine. Moreover, the engine was operated for 500 hours such that the operation of the engine at 5,000 rpm in a wide open throttle state for one minute and idling for 1 minute were repeated. The difference Δϕd in the diameter was changed in a range from 0.06 mm to 0.10 mm in a case where the potential of the central electrode 12 was made to be negative similarly to the conventional structure and in a case where the same was made to be positive like the present invention. Then, whether or not fracture occurred was examined. In FIG. 8B, symbol O indicated no occurrence of fracture and symbol x indicated occurrence of the fracture.

When the potential of the central electrode 12 was made to be negative as shown in FIG. 8B, fracture occurred in a range of the difference Δϕd of the diameter from 0.06 mm to 0.08 mm. When the potential of the central electrode 12 was made to be positive, no fracture occurred in all of the three experiments over the range of the difference Δϕd of the diameter from 0.06 mm to 0.10 mm.

That is, the present invention structured such that the potential of the central electrode 12 was made to be positive when voltage was applied was able to prevent fracture even if the difference Δϕd of the diameter was reduced.

Another embodiment of the spark plug for an internal combustion engine according to the present invention will now be described with reference to FIGS. 3 to 6.

Figure 3:
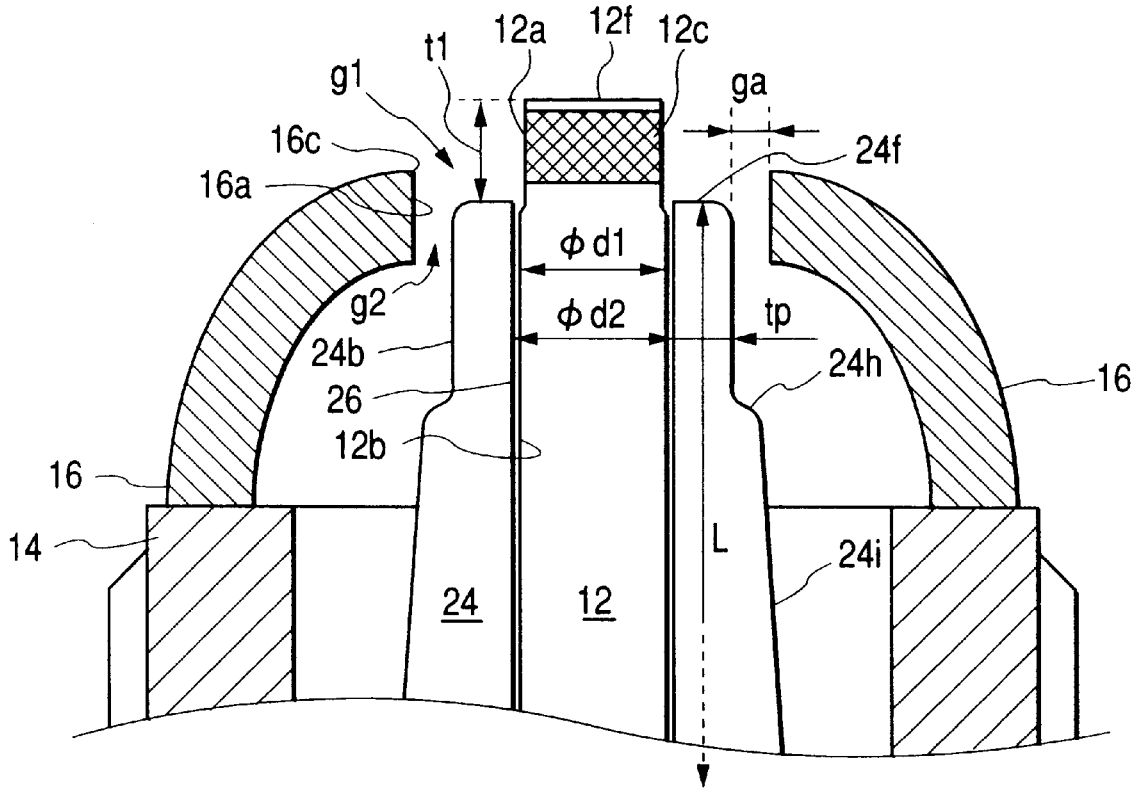
FIG. 3 is a diagram showing a spark plug for an internal combustion engine according to another embodiment.

The spark plug for an internal combustion engine shown in FIG. 3 has the structure that the front surface 12*f* of the central electrode 12 upward projects over the upper end 16*c* of the igniting surface 16*a*. Moreover, an elongated spark-resisting consumption member 12*c* is secured to the outer surface 12*a* of the projection.

The spark-resisting consumption member 12*c* is made of a material having a melting point higher than Inconel, which is a nickel alloy. The material is exemplified by noble-metal, a noble metal alloy or a sintered material of noble metal, such as platinum (Pt), platinum-iridium (Pt-Ir), platinum-nickel (Pt-Ni), platinum-iridium-nickel (Pt-Ir-Ni), platinum-rhodium (Pt-Rn), iridium-rhodium (Ir-Rh) and iridium-yttrium.

In the foregoing case, the discharge passage for a spark is mainly formed between the igniting surface 16*a* of the ground electrodes 16 and the spark-resisting consumption member 12*c*. That is, the discharge passage along the side surface 24*f* of the elongated leg portion 24 is reduced. Therefore, channeling of the side surface 24*f* adjacent to the igniting portion can be prevented. Moreover, the spark-resisting consumption member 12*c* is secured. Thus, the quantity of consumption of the central electrode 12 can be reduced.

That is, the structure shown in FIG. 3 is able to improve the durability of the spark plug for an internal combustion engine.

The diameter ϕd1 of the central electrode 12 is 1.8 mm which is smaller than that of the central electrode 12 shown in FIG. 1 by 0.3 mm. Therefore, the thermal capacity can be reduced and temperature can quickly be raised. Thus, ignitability can be improved.

The difference Δϕd of the diameter is 0.06 mm, while the gap ga is 0.6 mm. The foregoing values are the same as those of plug E employed in Experiment 1. However, thickness tp of the insulating member is 0.8 mm which is smaller than 0.9 mm of plug E by 0.1 mm. Therefore, the fouling resistance can furthermore be improved.

Figure 4:
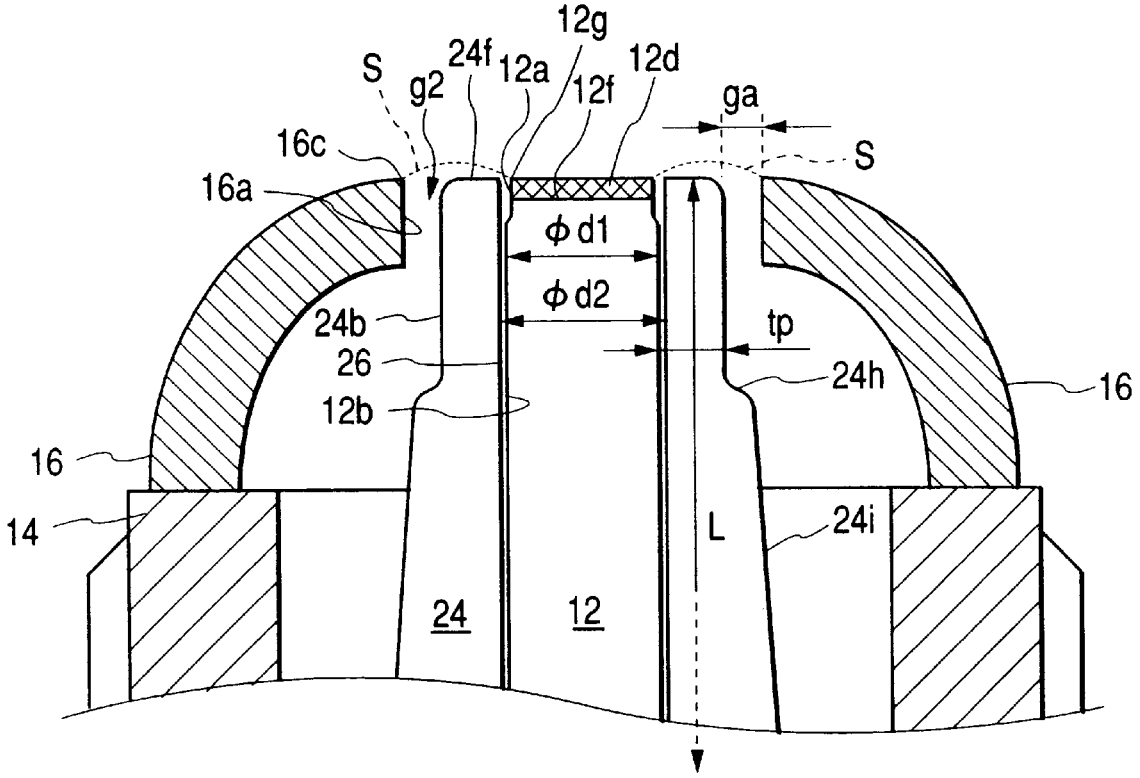
FIG. 4 is a diagram showing a spark plug for an internal combustion engine according to another embodiment.

A spark plug for an internal combustion engine shown in FIG. 4 has a structure that a spark-resisting consumption member 12*d* is secured to the front surface 12*f* of the central electrode 12. The front surface 12*f* of the central electrode 12, the side surface 24*f* of the elongated leg portion 24 adjacent to the igniting portion and the upper end 16*c* of the igniting surface 16*a* are flushed with one another.

The foregoing structure is free of opposite portions between the outer surface 12*a* of the central electrode 12 and the igniting surface 16*a* of the ground electrodes 16. When the degree of fouling does not proceed considerably, the discharge passage is formed between the upper end 16*c* of the igniting surface 16*a* and the end 12*g* of the central electrode 12 as indicated with symbol S shown in FIG. 4. Thus, the discharge passage bypasses the side surface 24*f* of the elongated leg portion 24.

Since occurrence of channeling can be prevented, the durability can be improved.

The diameter ϕd1 of the central electrode 12 is 1.6 mm which is furthermore smaller than that shown in FIG. 3 by 0.2 mm. Therefore, the ignitability can furthermore be improved.

Figure 5A:
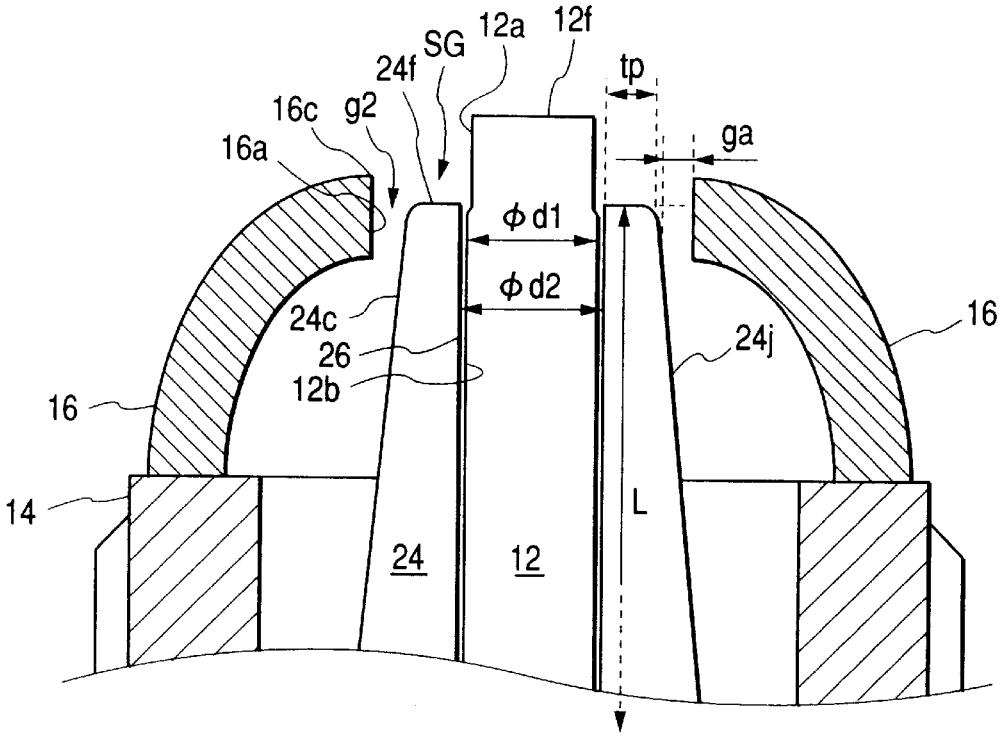
FIG. 5A is a diagram showing a spark plug for an internal combustion engine according to another embodiment.
Figure 5B:
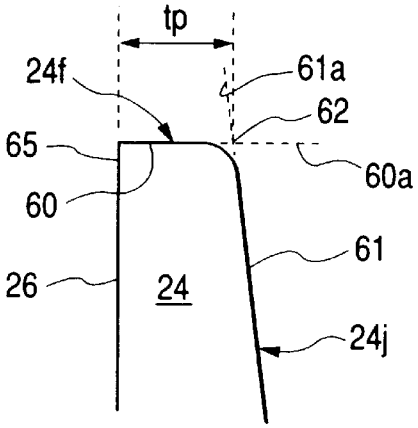
FIG. 5B is a diagram showing the thicknesses of the insulating member.

A spark plug for an internal combustion engine shown in FIG. 5A is characterized in that an outer surface 24*j* of the elongated leg portion 24 is tapered.

Although the shape of the elongated leg portion 24 is the same as that of the conventional spark plug, the thickness tp of the insulating member and the difference Δϕd in the diameter are the same as those shown in FIG. 3. Therefore, the durability can be improved as compared with the conventional spark plug similarly to the spark plug shown in FIG. 3.

That is, the structure that the thickness tp (see FIG. 5B) of the insulating member is reduced, the difference Δϕd in the diameter is reduced and the discharge voltage is applied such that the potential of the central electrode 12 is made to be positive enables the durability to be improved when the elongated leg portion 24 has the straight shape or the tapered shape.

Figure 6:
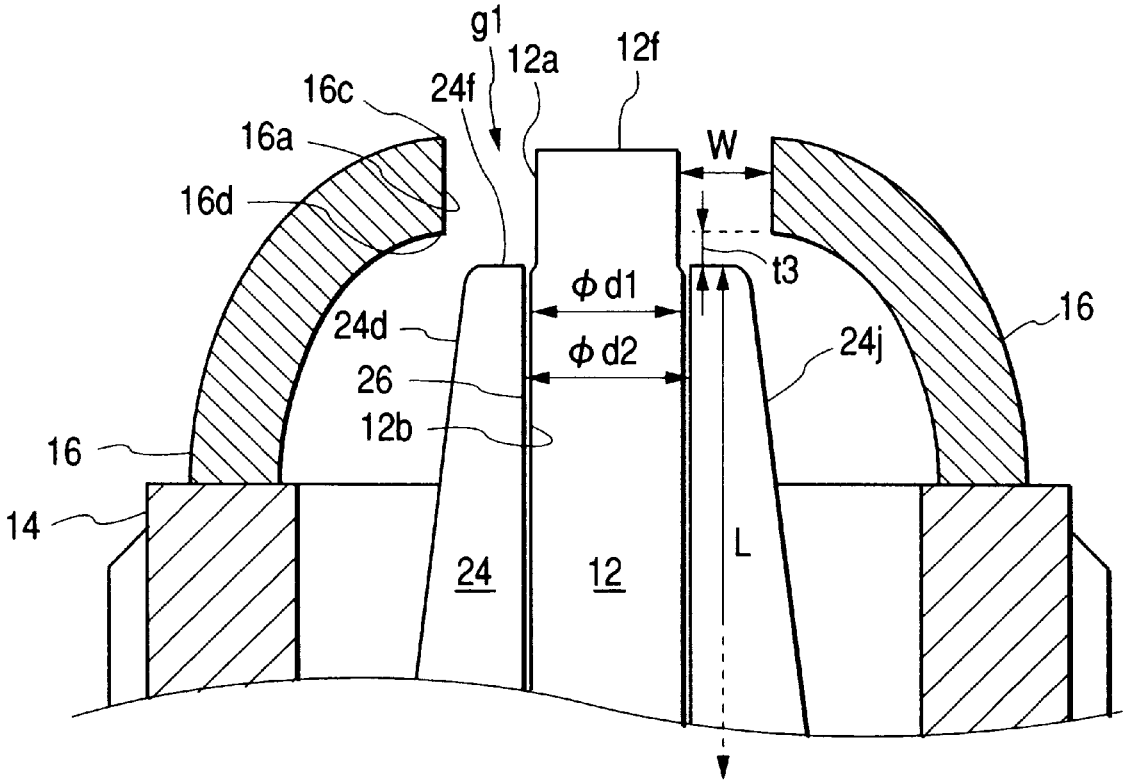
FIG. 6 is a diagram showing a spark plug for an internal combustion engine according to another embodiment.

A spark plug for an internal combustion engine shown in FIG. 6 is a so-called intermittent creepage discharge spark plug having a gap formed between the side surface 24*f* of the elongated leg portion 24 and the lower end 16*d* of the igniting surface 16*a* of the ground electrodes 16. The difference Δϕd in the diameter is 0.06 mm and length W of the first gap g1 is 1.1 mm.

The intermittent creepage discharge spark plug having the structure that the difference Δϕd in the diameter is reduced enables the length L of the leg to be elongated. Therefore, the fouling resistance can be improved.

As described above, any one of the structures shown in FIGS. 3 to 6 enables a spark plug for an internal combustion engine to be realized which exhibits improved durability as compared with the conventional structure.

It is preferable that the smallest thickness tp of the insulating member is 0.5 mm to obtain the effects of the present invention. It is preferable that the smallest difference Δϕd in the diameter is 0.04 mm (0.03 mm in consideration of dispersion).

What is claimed is:

1. A spark plug for an internal combustion engine comprising:

an insulating member having an axial hole formed along a central axis;

a rod-shape central electrode accommodated in said axial hole; and a ground electrode with which an igniting portion opposite to the outer surface of said central electrode is formed;

wherein said spark plug satisfies at least one of the following conditions (a) and (b):

(a) when said insulating member is cut along said central axis and a first extension line in the form obtained by outwards extending a line indicating an end surface of said insulating member adjacent to said igniting portion and a second extension line in the form obtained by extending a line indicating the outer surface of said insulating member in the vicinity of said igniting portion are drawn, the distance tp from an intersection between said first and second extension lines to a line indicating an inner surface of said axial hole adjacent to said igniting portion is 1.0 mm or shorter ($tp \leqq 1.0$ mm); and (b) the difference ($\phi d_2 - \phi d_1$) between diameter ($\phi d_1$ of said central electrode and diameter $\phi d_2$ of said axial hole is 0.08 mm or shorter.

2. The spark plug according to claim 1, wherein a front surface of said central electrode upward projects over an upper end of the igniting surface; and an elongated spark-resisting consumption member is secured to an outer surface of the projection.

3. The spark-plug according to claim 1, wherein a spark-resisting consumption member is secured to a front surface of said central electrode; and the front surface of said central electrode, a side surface of a elongated leg portion adjacent to the igniting portion and an upper end of the igniting surface are flushed with one another.

4. The spark plug according to claim 1, wherein an outer surface of an elongated leg portion is tapered.

5. A spark plug ignition system comprising:

a spark plug comprising an insulating member having an axial hole formed along a central axis; a rod-shape central electrode accommodated in said axial hole; and a ground electrode with which an igniting portion opposite to the outer surface of said central electrode is formed; wherein said spark plug satisfies at least one of the following conditions (a) and (b): (a) when said insulating member is cut along said central axis and a first extension line in the form obtained by outwards extending a line indicating an end surface of said insulating member adjacent to said igniting portion and a second extension line in the form obtained by extending a line indicating the outer surface of said insulating member in the vicinity of said igniting portion are drawn, the distance tp from an intersection between said first and second extension lines to a line indicating an inner surface of said axial hole adjacent to said igniting portion is 1.0 mm or shorter ($tp \leqq 1.0$ mm); and (b) the difference ($\phi d_2 - \phi d_1$) between diameter $\phi d_1$ of said central electrode and diameter $\phi d_2$ of said axial hole is 0.08 mm or shorter; and a voltage application means for applying voltage between said central electrode and said electrode so that the polarity of said central electrode is made to be positive and said ground electrode is made to be negative.

6. The spark plug ignition system according to claim 5, wherein a front surface of said central electrode upward projects over an upper end of the igniting surface; and an elongated spark-resisting consumption member is secured to an outer surface of the projection.

7. The spark plug ignition system according to claim 5, wherein a spark-resisting consumption member is secured to a front surface of said central electrode; and the front surface of said central electrode, a side surface of a elongated leg portion adjacent to the igniting portion and an upper end of the igniting surface are flushed with one another.

8. The spark plug ignition system according to claim 5, wherein an outer surface of an elongated leg portion is tapered.

* * * * *